US009634452B2

(12) United States Patent
Kilmartin

(10) Patent No.: US 9,634,452 B2
(45) Date of Patent: Apr. 25, 2017

(54) PRINTED CIRCUIT BOARD CONNECTOR EJECTOR

(71) Applicant: ATLANTIC INERTIAL SYSTEMS, INC., Cheshire, CT (US)

(72) Inventor: Brian David Kilmartin, Cheshire, CT (US)

(73) Assignee: ATLANTIC INERTIAL SYSTEMS, INC., Cheshire, CT (US)

( * ) Notice: Subject to any disclaimer, the term of this patent is extended or adjusted under 35 U.S.C. 154(b) by 0 days.

(21) Appl. No.: 14/193,871

(22) Filed: Feb. 28, 2014

(65) Prior Publication Data

US 2015/0064945 A1 Mar. 5, 2015

Related U.S. Application Data

(60) Provisional application No. 61/872,029, filed on Aug. 30, 2013.

(51) Int. Cl.

| | |
|---|---|
| ***H01R 43/20*** | (2006.01) |
| ***H01R 12/70*** | (2011.01) |
| ***H01R 12/71*** | (2011.01) |
| ***H01R 13/633*** | (2006.01) |
| ***H01R 13/62*** | (2006.01) |

(52) U.S. Cl.

CPC ..... *H01R 43/205* (2013.01); *H01R 12/7076* (2013.01); *H01R 12/716* (2013.01); *H01R 13/62* (2013.01); *H01R 13/633* (2013.01)

(58) Field of Classification Search

CPC .. H01R 13/633; H01R 23/7005; H01R 13/62; H01R 12/4005; H01R 12/7076

USPC ..... 439/152, 153, 159, 160, 581, 320, 374, 439/620.22

See application file for complete search history.

(56) References Cited

U.S. PATENT DOCUMENTS

| | | | | |
|---|---|---|---|---|
| 1,621,341 | A * | 3/1927 | Vogt | H01R 33/971 439/360 |
| 4,140,359 | A | 2/1979 | Kunz | |
| 4,695,258 | A * | 9/1987 | Hanson et al. | 439/67 |
| 4,999,744 | A | 3/1991 | Blankenship | |
| 5,035,640 | A * | 7/1991 | Drogo | 439/321 |
| 5,334,043 | A * | 8/1994 | Dvorak, Jr. | G01R 1/07328 439/364 |
| 5,443,395 | A | 8/1995 | Wang | |
| 6,034,325 | A * | 3/2000 | Nattel et al. | 174/59 |
| 6,226,068 | B1 * | 5/2001 | Arcykiewicz et al. | 439/314 |
| 6,299,465 | B1 | 10/2001 | Hirata | |
| 7,066,759 | B2 | 6/2006 | Griffin | |
| 7,309,250 | B2 | 12/2007 | Reed et al. | |
| 7,347,706 | B1 * | 3/2008 | Wu | H01R 13/7175 430/642 |

(Continued)

*Primary Examiner* — James Harvey
*Assistant Examiner* — Oscar C Jimenez
(74) *Attorney, Agent, or Firm* — Cantor Colburn LLP

(57) ABSTRACT

A printed circuit board connector ejector includes a body extending from a first end to a second end. The body includes an outer surface and a passage extending through the body between the first and second ends. A plurality of threads extend at least partially though the passage. The plurality of threads is configured and disposed to engage with an electrical connector. An actuation member extends radially outwardly from the outer surface. The actuation member is configured and disposed to facilitate rotation of the body relative to an electrical connector.

15 Claims, 4 Drawing Sheets

(56) References Cited

U.S. PATENT DOCUMENTS

| | | | | |
|---|---|---|---|---|
| 8,542,490 | B2 | 9/2013 | Kokas et al. | |
| 8,616,903 | B2 | 12/2013 | Li et al. | |
| 2002/0122304 | A1 | 9/2002 | Duncan | |
| 2004/0038587 | A1* | 2/2004 | Yeung et al. | 439/581 |
| 2007/0243762 | A1* | 10/2007 | Burke et al. | 439/589 |
| 2010/0320530 | A1 | 12/2010 | Cheng | |
| 2012/0077368 | A1* | 3/2012 | Proeckl | 439/475 |

* cited by examiner

PRINTED CIRCUIT BOARD CONNECTOR EJECTOR

CROSS-REFERENCE TO RELATED APPLICATION

This application is a Non-Provisional Application of U.S. Provisional Application No. 61/872,029 filed Aug. 30, 2013, the disclosure of which is incorporated by reference herein in its entirety.

BACKGROUND OF THE INVENTION

Exemplary embodiments pertain to the art of printed circuit boards and, more particularly, to a connector ejector for a printed circuit board.

Printed circuit boards include a variety of connections that receive connectors. The connections provide an interface between circuits on the printed circuit board and other electrical devices, boards and the like. Oftentimes the connections include a number of terminals that are received by the connector, or the connector may include a number of terminals that are received by the connections on the printed circuit board. Occasionally, removing a connector from a connection proves difficult. Over time, the connector may become stuck on the terminals, or the terminals may become stuck in the connector. Further, there may not be an abundance of room about the connector to enable good contact to facilitate removal.

BRIEF DESCRIPTION OF THE INVENTION

Disclosed is a printed circuit board connector ejector including a body extending from a first end to a second end. The body includes an outer surface and a passage extending through the body between the first and second ends. A plurality of threads extend at least partially though the passage. The plurality of threads is configured and disposed to engage with an electrical connector. An actuation member extends radially outwardly from the outer surface. The actuation member is configured and disposed to facilitate rotation of the body relative to an electrical connector.

Also disclosed is a method of ejecting an electrical connector from a printed circuit board. The method includes rotating the ejector relative to the electrical connector, shifting the ejector away from the electrical connector toward a surface of the printed circuit board, engaging an end of the ejector with the surface of the printed circuit board, and further rotating the ejector causing the electrical connector to disengage from the printed circuit board.

BRIEF DESCRIPTION OF THE DRAWINGS

The following descriptions should not be considered limiting in any way. With reference to the accompanying drawings, like elements are numbered alike.

DETAILED DESCRIPTION OF THE INVENTION

A detailed description of one or more embodiments of the disclosed apparatus and method are presented herein by way of exemplification and not limitation with reference to the Figures.

Figure 1:
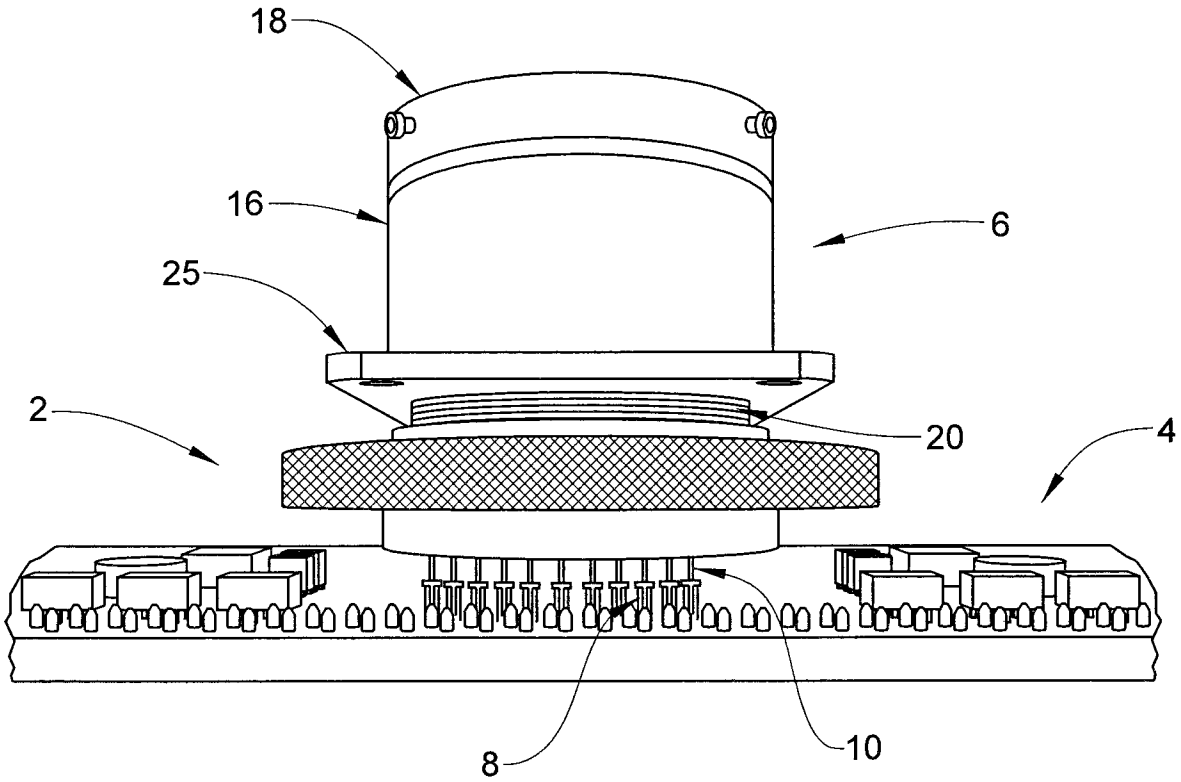
FIG. 1 is a side view of a printed circuit board connector ejector, in accordance with an exemplary embodiment.

A printed circuit board connector ejector, in accordance with an exemplary embodiment, is illustrated generally at 2 in FIG. 1. Printed circuit board connector ejector 2 is arranged between a printed circuit board (PCB) 4 and an electrical connector 6. PCB 4 includes a plurality of terminal receivers 8. Electrical connector 6 includes a plurality of terminals 10 that matingly engage with terminal receivers 8. Of course it should be understood that terminals could be provided on PCB 4 and terminal receivers could be formed in electrical connector 6. Also, it should be understood that electrical connector 6 is just one example of a connector. The electrical connector may also be another PCB, a bulkhead having an electrical connector formed therein, or a bulkhead supporting an electrical connector. Electrical connector 6 includes a body portion 16 extending from an interface receiving end 18 to a terminal support end 20. Interface receiving end 18 is configured to receive an electrical cable (not shown) including a plurality of conductors (also not shown). Terminal support end 20 includes threads 22 and extends through, and engages with, printed circuit board connector ejector 2, as will be discussed more fully below. Electrical connector 6 is also shown to include a flange 25.

Figure 2:
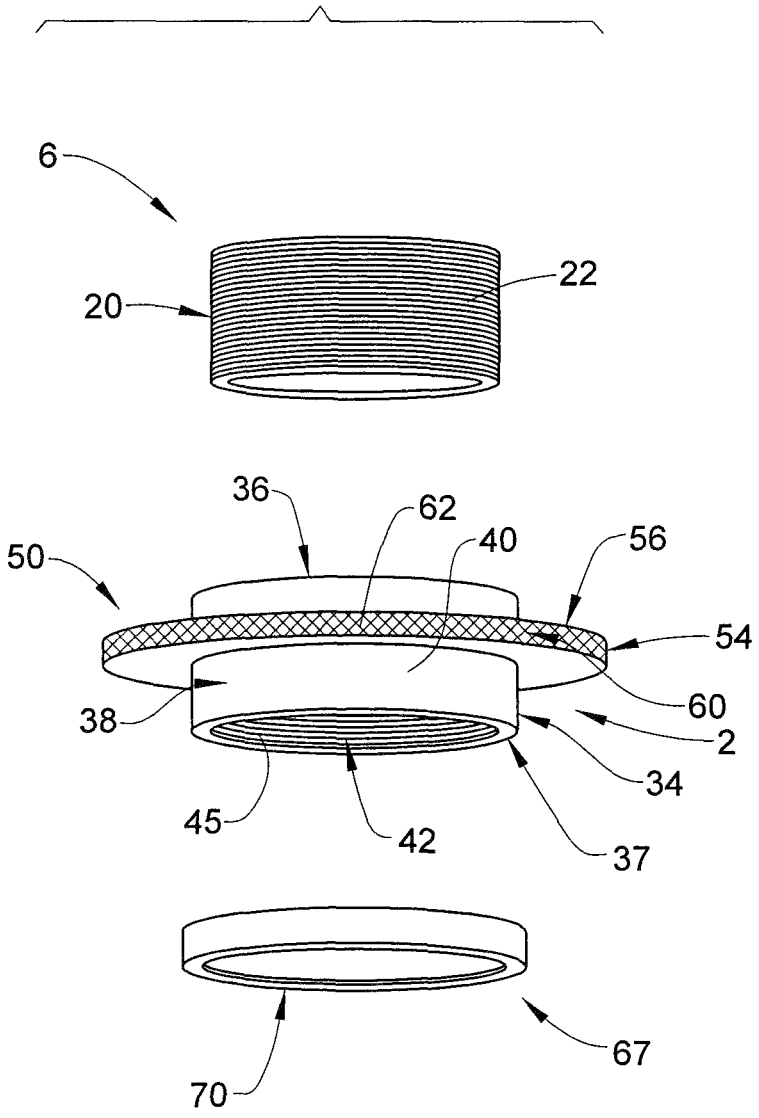
FIG. 2 is a disassembled view of the ejector of FIG. 1.

As shown in FIG. 2, printed circuit board connector ejector 2 includes a body 34 that extends from a first end 36 to a second end 37 through an intermediate portion 38. Body 34 may be formed from an electrically conductive material including various metals, or electrically insulated materials including plastics, ceramics and the like. Body 34 includes an outer surface 40 and an internal passage 42. Internal passage 42 includes a plurality of threads 45 that engage with threads 22 on terminal support end 20 of electrical connector 6. Printed circuit board connector ejector 2 includes an actuation member 50 that facilitates rotation of body 34 relative to electrical connector 6. Actuation member 50 extends annularly about body 34 and includes a radially outwardly facing surface 54 and an axially outwardly facing surface 56. Actuation member 50 also includes another, opposing, axially outwardly facing surface (not separately labeled). In the exemplary aspect shown, radially outwardly facing surface 54 may include a gripping feature 60. Gripping feature 60 may take the form of knurling 62 that roughens radially outwardly facing surface 54 to improve gripping.

In accordance with an exemplary embodiment, printed circuit board connector ejector 2 is engaged over terminal support end 20 and electrical connector 6 is coupled to PCB 4. To loosen and remove electrical connector 6, printed circuit board connector ejector 2 is rotated into contact with PCB 4. Once contact is established, further rotation of printed circuit board connector ejector 2 causes electrical connector 6 to move away from PCB 4 with terminals 10 disengaging from terminal receivers 8. Printed circuit board connector ejector 2 is also shown to include a low friction element 67. Low friction element 67 is shown in the form of an end cap 70 formed from a low friction material such as nylon, Delrin and the like. Low friction element 67 reduces wear and facilitates rotation of printed circuit board connector ejector 2 when body 34 is rotated into contact with PCB 4.

Figure 3:
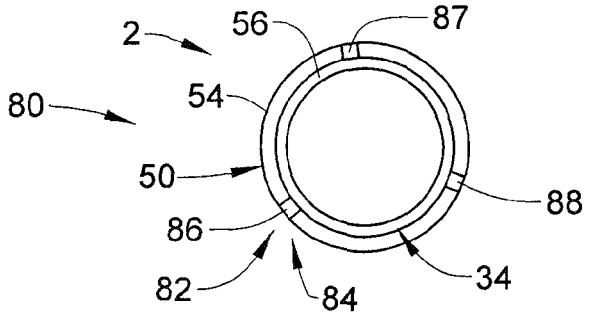
FIG. 3 is a top view of an ejector, in accordance with another aspect of the exemplary embodiment.
Figure 4:
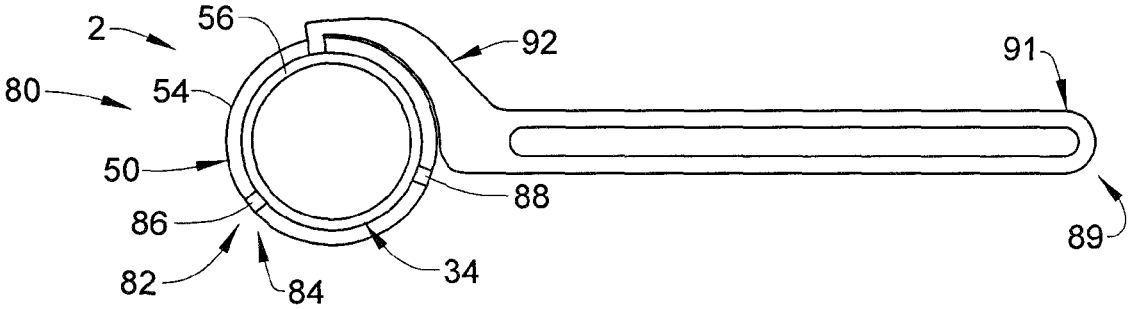
FIG. 4 is a top view of the ejector of FIG. 1 engaged with a hook spanner.

FIG. 3, in which like numbers represent corresponding parts in the respective views, illustrates a printed circuit board connector ejector 80, in accordance with another aspect of the exemplary embodiment. Printed circuit board connector ejector 80 includes gripping features 82 formed in radially outwardly facing surface 54. In the exemplary embodiment shown, gripping features 82 take the form of recesses 84. Recesses 84 may include a first recess 86, a second recess 87 and a third recess 88. Recesses 86-88 are configured and arranged to be engaged by a tool 89, such as shown in FIG. 4. Tool 89 takes the form of a hook spanner 91 having a gripping element 92 that engages with one of recesses 86, 87, and 88 to rotate body 34.

Figure 5:
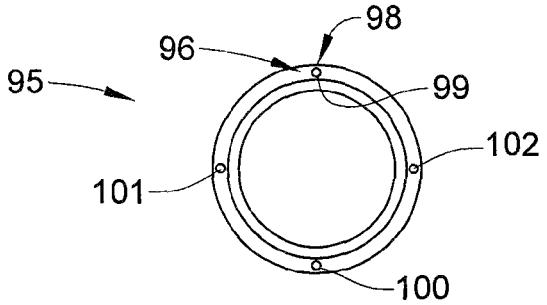
FIG. 5 is a top view of an ejector, in accordance with yet another aspect of the exemplary embodiment.
Figure 6:
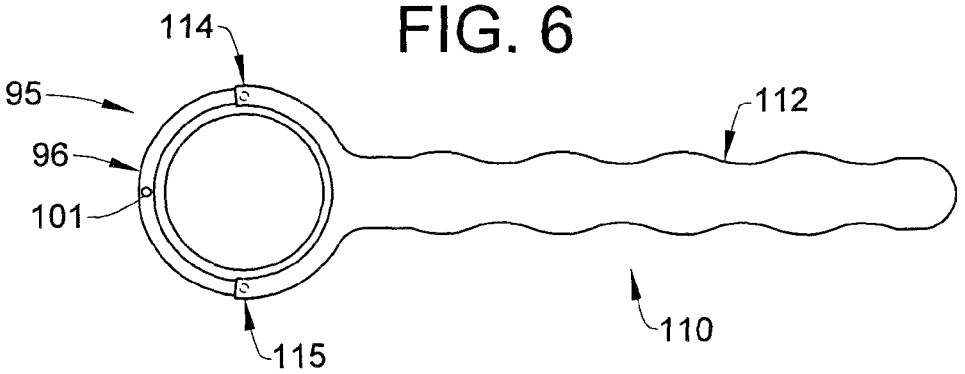
FIG. 6 is a top view of the ejector of FIG. 5 engaged with a pin spanner.

FIG. 5, in which like numbers represent corresponding parts in the respective views, illustrates a printed circuit board connector ejector 95, in accordance with another aspect of the exemplary embodiment. Printed circuit board connector ejector 95 includes gripping features 96 formed in axially outwardly facing surface 56. In the exemplary embodiment shown, gripping features 96 take the form of recesses 98. Recesses 98 may include a first recess 99, a second recess 100, as well as a third recess 101, and an opposing fourth recess 102. Recesses 99-102 may take the form of circular openings that are configured and arranged to be engaged by a tool 110, such as shown in FIG. 6. Tool 110 takes the form of a pin spanner 112 having gripping elements 114 and 115 that engage with one of recesses 99 and 100.

Figure 7:
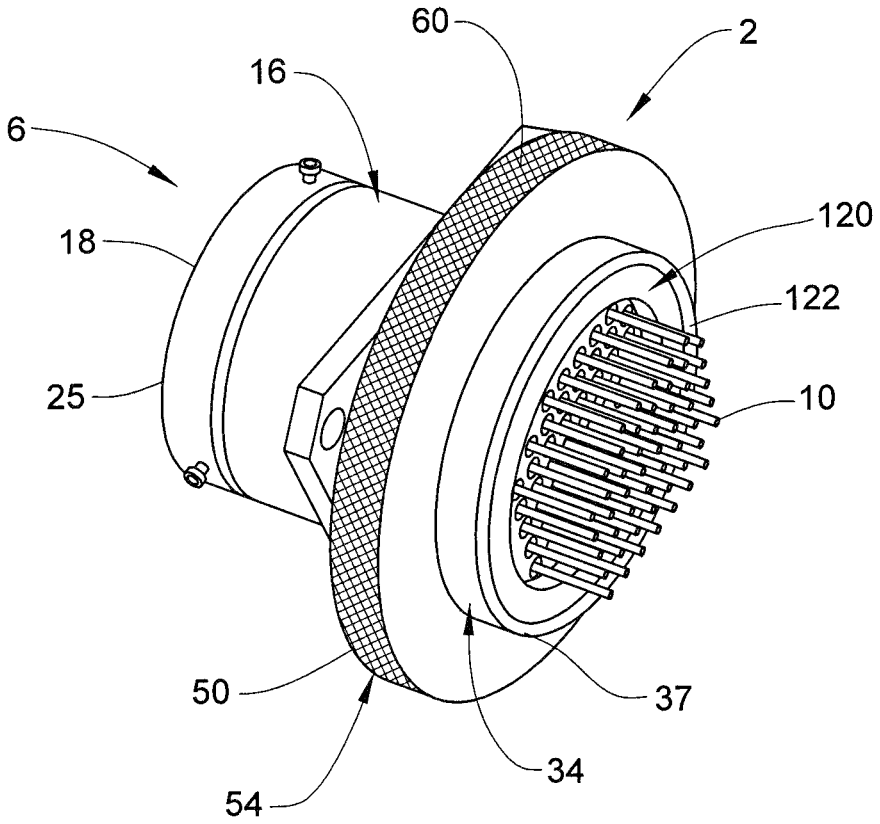
FIG. 7 is a perspective view of an ejector, in accordance with still yet another aspect of the exemplary embodiment.

At this point it should be understood that the exemplary embodiments provide an ejector for facilitating removal of a connector from a PCB, to facilitate separation of two or more PCB's, and/or to facilitate the separation of a PCB and a bulkhead. The ejector may be formed from a number of materials including both electrically conducting materials and electrically insulating materials. If formed from a low friction material, there may not be a need to also include a low friction element. Further, the low friction element may also be eliminated if the PCB includes a low friction coating. Further the ejector includes an actuation member that includes a gripping feature. The gripping feature may include a surface roughness such as knurling, or recesses, the number of which can vary. In addition, the ejector includes a low friction element. In addition to the end cap shown, the ejector may include a low friction element, such as shown at 120 in FIG. 7. Low friction element 120 takes the form of an insert 122 formed from a material having a low coefficient of friction. In lieu of using a low friction element, the ejector may be coated with a material having a low coefficient of friction such as a ceramic coating, an epoxy coating, or a powder coating.

While the invention has been described with reference to an exemplary embodiment or embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the claims.

What is claimed is:

1. A printed circuit board connector ejector comprising:

a body extending from a first end to a second end, the body including an outer surface and a passage extending through the body between the first and second ends;

a plurality of threads formed on an inner side of the passage and extending through the passage from the first end to the second end, the plurality of threads being configured and disposed to engage with an electrical connector; and an actuation member extending radially outwardly from the outer surface, the actuation member being configured and disposed to facilitate rotation of the body relative to the electrical connector and the printed circuit board to disengage the electrical connector from the printed circuit board;

wherein the body is disposed between a printed circuit board and the electrical connector.

2. The printed circuit board connector ejector according to claim 1, further comprising: a low friction element provided at the second end of the body.

3. The printed circuit board connector ejector according to claim 2, wherein the low friction element comprises at least one of a nylon material and a Delrin material.

4. The printed circuit board connector ejector according to claim 2, wherein the low friction element comprises an end cap.

5. The printed circuit board connector ejector according to claim 1, wherein the body is formed from an electrically conductive material.

6. The printed circuit board connector ejector according to claim 1, wherein the body is formed from an electrically insulated material.

7. The printed circuit board connector ejector according to claim 1, wherein the body is provided with a covering comprising one of a ceramic coating, an epoxy coating and a powder coating.

8. A printed circuit board connector ejector comprising:

a body extending from a first end to a second end, the body including an outer surface and a passage extending through the body between the first and second ends;

a plurality of threads formed on an inner side of the passage and extending through the passage from the first end to the second end, the plurality of threads being configured and disposed to engage with an electrical connector; and an actuation member extending radially outwardly from the outer surface, the actuation member being configured and disposed to facilitate rotation of the body relative to the electrical connector and a printed circuit board to disengage the electrical connector from the printed circuit board;

wherein the actuation member extends annularly about the body and includes a radially outwardly facing surface and at least one axially outwardly facing surface.

9. The printed circuit board connector ejector according to claim 8, wherein the radially outwardly facing surface includes a gripping feature.

10. The printed circuit board connector ejector according to claim 9, wherein the gripping feature comprises knurling.

11. The printed circuit board connector ejector according to claim 9, wherein the gripping feature comprises at least one recess formed in the radially outwardly facing surface.

12. The printed circuit board connector ejector according to claim 11, wherein the at least one recess comprises first, second and third recesses formed in the radially outwardly facing surface.

13. The printed circuit board connector ejector according to claim 8, wherein the at least one axially outwardly facing surface includes at least one gripping feature.

14. The printed circuit board connector ejector according to claim 13, wherein the at least one gripping feature comprises at least one recess formed in the axially outwardly facing surface.

15. The printed circuit board connector ejector according to claim 13, wherein the at least one recess comprises first and second radially opposing recesses.

* * * * *